US005732751A

United States Patent [19]

Schmidt et al.

[11] Patent Number: 5,732,751

[45] Date of Patent: Mar. 31, 1998

[54] FILLING INK SUPPLY CONTAINERS

[75] Inventors: Glen E. Schmidt; Mark J. Green; Ronald W. Hall; Truman Kenneth Jones, all of Corvallis, Oreg.

[73] Assignee: Hewlett-Packard Company, Palo Alto, Calif.

[21] Appl. No.: 566,526

[22] Filed: Dec. 4, 1995

[51] Int. Cl.[6] ..... B41J 2/175

[52] U.S. Cl. ..... 141/48; 141/2; 141/7; 141/21; 141/54; 141/61; 141/63; 141/64; 141/91; 347/7; 347/86; 53/328; 53/468; 53/489

[58] Field of Search ..... 141/48, 54, 59, 141/61, 63, 64, 2, 5, 7, 18, 21, 91, 92; 347/7, 85–87; 53/328, 359, 468, 489

[56] References Cited

U.S. PATENT DOCUMENTS

| | | | |
|---|---|---|---|
| 594,196 | 11/1897 | Cramer . | |
| 714,264 | 11/1902 | Turajski . | |
| 743,798 | 11/1903 | Allwardt . | |
| 1,150,420 | 8/1915 | Davis | 285/308 |
| 1,304,814 | 5/1919 | Schweinert . | |
| 1,451,037 | 4/1923 | Blanchard . | |
| 1,563,331 | 12/1925 | Bright . | |
| 1,588,898 | 6/1926 | Martocello . | |
| 1,638,488 | 8/1927 | Kellogg . | |
| 1,759,872 | 5/1930 | Schwimmer . | |
| 1,767,391 | 6/1930 | Muller . | |
| 1,850,879 | 3/1932 | Hunt . | |
| 1,859,018 | 5/1932 | Bedford . | |
| 1,918,602 | 7/1933 | Joyce . | |
| 2,011,639 | 8/1935 | Johannesson | 141/20.5 |
| 2,024,682 | 12/1935 | Eisenman . | |
| 2,086,569 | 7/1937 | Meyer . | |
| 2,092,116 | 9/1937 | Hansen . | |
| 2,258,919 | 10/1941 | Wallace . | |
| 2,265,267 | 12/1941 | Cowles . | |
| 2,288,565 | 6/1942 | Green . | |
| 2,327,611 | 8/1943 | Scheiwer . | |
| 2,370,182 | 2/1945 | Morrow . | |
| 2,373,886 | 4/1945 | Geiger . | |
| 2,412,685 | 4/1946 | Hoffman et al. . | |
| 2,434,167 | 1/1948 | Knoblauch . | |
| 2,459,477 | 1/1949 | Schuyver . | |
| 2,492,271 | 12/1949 | Cox . | |
| 2,557,807 | 6/1951 | Wagner . | |
| 2,598,009 | 5/1952 | Peeps . | |
| 2,612,389 | 9/1952 | MacGlashan . | |
| 2,727,759 | 12/1955 | Elliott . | |
| 2,789,838 | 4/1957 | Palm . | |
| 2,842,382 | 7/1958 | Franck . | |
| 2,855,006 | 10/1958 | Geisler | 141/48 X |
| 2,888,173 | 5/1959 | Wilcott . | |
| 2,915,325 | 12/1959 | Foster | 285/276 |
| 2,919,935 | 1/1960 | Nyberg . | |

(List continued on next page.)

FOREIGN PATENT DOCUMENTS

| | | |
|---|---|---|
| 523915A2 | 1/1993 | European Pat. Off. . |
| 579492A1 | 1/1994 | European Pat. Off. . |
| 640484A2 | 3/1995 | European Pat. Off. . |
| 645243A2 | 3/1995 | European Pat. Off. . |
| 672527A2 | 9/1995 | European Pat. Off. . |
| 2003793A | 3/1979 | United Kingdom . |

*Primary Examiner*—J. Casimer Jacyna

[57] ABSTRACT

An ink supply container for an ink-jet printer is provided with a main reservoir, which is typically maintained at ambient pressure. The main reservoir is coupled to a variable volume chamber via a one-way valve which allows the flow of ink from the reservoir to the chamber and prevents the flow of ink from the chamber to the reservoir. The chamber is coupled to a fluid outlet which is normally closed to prevent the flow of ink. A fill port is provided for directing ink into the reservoir to fill the reservoir. The apparatus and method for filling the ink container includes a nozzle that seals around the fill port and that has valved fluid lines connected thereto for evacuating the container prior to filling and for directing ink into the evacuated reservoir. The nozzle surrounds a plug that is moved to seal the port while the nozzle is still sealed around the port immediately after the container is filled.

11 Claims, 6 Drawing Sheets

U.S. PATENT DOCUMENTS

| | | | |
|---|---|---|---|
| 2,925,103 | 2/1960 | Kerr . | |
| 3,057,131 | 10/1962 | McKinley et al. | 53/328 X |
| 3,102,770 | 9/1963 | McKeegan | 346/140.1 |
| 3,104,088 | 9/1963 | Cator . | |
| 3,106,379 | 10/1963 | Sciuto . | |
| 3,140,912 | 7/1964 | Davis | 346/140.1 |
| 3,152,452 | 10/1964 | Bond, Jr. . | |
| 3,157,314 | 11/1964 | Nadler . | |
| 3,170,667 | 2/1965 | Szohatzky . | |
| 3,223,117 | 12/1965 | Curie . | |
| 3,230,964 | 1/1966 | Debrotnic . | |
| 3,279,497 | 10/1966 | Norton . | |
| 3,339,883 | 9/1967 | Drake . | |
| 3,359,015 | 12/1967 | Zahuranec . | |
| 3,430,824 | 3/1969 | Conners . | |
| 3,490,473 | 1/1970 | Ehrens . | |
| 3,493,146 | 2/1970 | Conners . | |
| 3,537,477 | 11/1970 | Mahoff . | |
| 3,613,959 | 10/1971 | Mason . | |
| 3,614,940 | 10/1971 | Abrams et al. . | |
| 3,640,309 | 2/1972 | Demler, Sr. . | |
| 3,708,798 | 1/1973 | Hildenbrand . | |
| 3,777,771 | 12/1973 | De Visscher | 137/1 |
| 3,777,782 | 12/1973 | Shendure . | |
| 3,787,882 | 1/1974 | Fillmore . | |
| 3,805,276 | 4/1974 | Ishii . | |
| 3,825,222 | 7/1974 | Petrova . | |
| 3,831,727 | 8/1974 | Kruspe . | |
| 3,873,062 | 3/1975 | Johnson . | |
| 3,896,853 | 7/1975 | Bernhard . | |
| 3,924,654 | 12/1975 | Buller . | |
| 3,950,761 | 4/1976 | Kashio . | |
| 3,961,337 | 6/1976 | Jung . | |
| 4,053,901 | 10/1977 | Skafvenstedt . | |
| 4,053,902 | 10/1977 | Skafvenstedt . | |
| 4,074,284 | 2/1978 | Dexter . | |
| 4,079,384 | 3/1978 | Takano . | |
| 4,084,165 | 4/1978 | Skafvenstedt . | |
| 4,114,853 | 9/1978 | Medvick . | |
| 4,119,034 | 10/1978 | Wax . | |
| 4,122,457 | 10/1978 | Erickson . | |
| 4,126,868 | 11/1978 | Kirner . | |
| 4,131,899 | 12/1978 | Christou . | |
| 4,142,653 | 3/1979 | Mascia . | |
| 4,149,172 | 4/1979 | Heinzl . | |
| 4,156,244 | 5/1979 | Erickson | 347/86 |
| 4,178,595 | 12/1979 | Jinnai | 347/7 |
| 4,183,031 | 1/1980 | Kyser . | |
| 4,187,511 | 2/1980 | Robinson . | |
| 4,204,215 | 5/1980 | Nakarai . | |
| 4,234,885 | 11/1980 | Arway . | |
| 4,253,103 | 2/1981 | Heinzl . | |
| 4,263,602 | 4/1981 | Matsumoto . | |
| 4,270,133 | 5/1981 | Shimazawa . | |
| 4,287,523 | 9/1981 | Thomas . | |
| 4,303,929 | 12/1981 | Blanck | 347/86 |
| 4,320,407 | 3/1982 | Goldis . | |
| 4,323,907 | 4/1982 | Italiano . | |
| 4,324,239 | 4/1982 | Gordon . | |
| 4,329,698 | 5/1982 | Smith . | |
| 4,339,761 | 7/1982 | Matsumoto . | |
| 4,340,896 | 7/1982 | Cruz-Uribe . | |
| 4,342,041 | 7/1982 | Kasugayama . | |
| 4,342,042 | 7/1982 | Cruz-Uribe . | |
| 4,345,627 | 8/1982 | Cassia . | |
| 4,357,617 | 11/1982 | Shimazawa . | |
| 4,371,004 | 2/1983 | Sysolin . | |
| 4,376,283 | 3/1983 | Bower . | |
| 4,380,772 | 4/1983 | Italiano . | |
| 4,383,263 | 5/1983 | Ozawa . | |
| 4,394,669 | 7/1983 | Ozawa . | |
| 4,403,229 | 9/1983 | Bartek . | |
| 4,412,232 | 10/1983 | Weber . | |
| 4,413,267 | 11/1983 | Hein . | |
| 4,419,677 | 12/1983 | Kasugayama . | |
| 4,421,296 | 12/1983 | Stephens . | |
| 4,422,084 | 12/1983 | Saito . | |
| 4,422,086 | 12/1983 | Miura . | |
| 4,429,320 | 1/1984 | Hattori . | |
| 4,433,341 | 2/1984 | Thomas . | |
| 4,447,820 | 5/1984 | Terasawa . | |
| 4,456,916 | 6/1984 | Kocot . | |
| 4,460,904 | 7/1984 | Oszczakiewicz . | |
| 4,462,037 | 7/1984 | Bangs . | |
| 4,471,364 | 9/1984 | Kocot . | |
| 4,475,116 | 10/1984 | Sicking . | |
| 4,476,472 | 10/1984 | Aiba . | |
| 4,496,959 | 1/1985 | Frerichs . | |
| 4,496,960 | 1/1985 | Fischbeck . | |
| 4,498,658 | 2/1985 | Mikiya . | |
| 4,500,895 | 2/1985 | Buck . | |
| 4,502,059 | 2/1985 | Blessington . | |
| 4,506,862 | 3/1985 | Spinosa . | |
| 4,509,659 | 4/1985 | Cloutier . | |
| 4,511,906 | 4/1985 | Hara . | |
| 4,520,369 | 5/1985 | Shackleton . | |
| 4,527,170 | 7/1985 | Iwasaki . | |
| 4,527,175 | 7/1985 | Kojima . | |
| 4,536,777 | 8/1985 | Matsumoto . | |
| 4,541,457 | 9/1985 | Blenkush . | |
| 4,542,386 | 9/1985 | Delligatii . | |
| 4,542,390 | 9/1985 | Bruning . | |
| 4,555,719 | 11/1985 | Arway . | |
| 4,558,326 | 12/1985 | Kimura . | |
| 4,568,954 | 2/1986 | Rosback | 347/86 |
| 4,575,738 | 3/1986 | Sheufelt . | |
| 4,576,199 | 3/1986 | Svensson . | |
| 4,586,058 | 4/1986 | Yamazaki . | |
| 4,590,494 | 5/1986 | Ichihashi . | |
| 4,591,875 | 5/1986 | McCann . | |
| 4,593,294 | 6/1986 | Parisi . | |
| 4,597,245 | 7/1986 | Parker | 53/328 X |
| 4,599,625 | 7/1986 | Terasawa . | |
| 4,600,927 | 7/1986 | Sugitani . | |
| 4,628,334 | 12/1986 | Dagna et al. | 346/140 |
| 4,832,096 | 5/1989 | Kohlbach | 141/91 X |
| 4,867,315 | 9/1989 | Baldwin | 53/489 X |
| 4,898,209 | 2/1990 | Zbed . | |
| 4,907,019 | 3/1990 | Stephens . | |
| 4,910,529 | 3/1990 | Regnault . | |
| 4,911,203 | 3/1990 | Garms . | |
| 4,920,360 | 4/1990 | Terasawa . | |
| 4,926,196 | 5/1990 | Mizoguchi . | |
| 4,928,126 | 5/1990 | Asai . | |
| 4,929,109 | 5/1990 | Ikenaga . | |
| 4,931,044 | 6/1990 | Beiter . | |
| 4,931,814 | 6/1990 | Yoshimura . | |
| 4,934,655 | 6/1990 | Blenkush . | |
| 4,935,751 | 6/1990 | Hamlin . | |
| 4,940,995 | 7/1990 | Hine . | |
| 4,940,997 | 7/1990 | Hamlin et al. . | |
| 4,942,901 | 7/1990 | Vescovini . | |
| 4,953,756 | 9/1990 | Breault . | |
| 4,957,483 | 9/1990 | Gonser . | |
| 4,958,754 | 9/1990 | Dennis . | |
| 4,959,667 | 9/1990 | Kaplinsky . | |
| 4,961,082 | 10/1990 | Hoisington . | |
| 4,967,207 | 10/1990 | Ruder | 347/7 |
| 4,968,998 | 11/1990 | Allen | 347/7 |
| 4,970,533 | 11/1990 | Saito . | |
| 4,973,993 | 11/1990 | Allen . | |
| 4,977,413 | 12/1990 | Yamanaka . | |

4,987,429 1/1991 Finley .
4,991,820 2/1991 Kohn .
4,992,802 2/1991 Dion .
4,995,940 2/1991 Hine .
4,999,652 3/1991 Chan .
5,002,254 3/1991 Belisaire .
5,008,688 4/1991 Ebinuma .
5,025,270 6/1991 Umezawa .
5,026,024 6/1991 Ito .
5,030,973 7/1991 Nonoyama .
5,043,746 8/1991 Abe .
5,053,787 10/1991 Terasawa .
5,070,347 12/1991 Yuki .
5,074,524 12/1991 Wade .
5,119,115 6/1992 Buat .
5,126,767 6/1992 Asai .
5,136,305 8/1992 Ims .
5,136,309 8/1992 Iida .
5,153,612 10/1992 Dunn ..... 347/87
5,155,502 10/1992 Kimura .
5,159,348 10/1992 Dietl .
5,182,581 1/1993 Kashimura .
5,187,498 2/1993 Burger .
5,189,438 2/1993 Hine .
5,199,470 4/1993 Goldman .
5,206,668 4/1993 Lo et al. .
5,215,231 6/1993 Paczonay .
5,216,452 6/1993 Suzuki .
5,220,345 6/1993 Hirosawa .
5,221,935 6/1993 Uzita .
5,221,936 6/1993 Saito .
5,245,915 9/1993 Ford .
5,255,827 10/1993 Breault .
5,270,739 12/1993 Kitani .
5,280,300 1/1994 Fong ..... 347/87
5,283,593 2/1994 Wehl .
5,289,212 2/1994 Carlotta .
5,293,913 3/1994 Preszler et al. ..... 141/367
5,305,920 4/1994 Reiboldt .
5,306,125 4/1994 Weag .
5,307,091 4/1994 DeCoste, Jr. .
5,311,214 5/1994 Hirasawa .
5,320,326 6/1994 Ju .
5,328,055 7/1994 Battle .
5,329,294 7/1994 Ontawar ..... 347/87
5,331,339 7/1994 Takahashi .
5,337,925 8/1994 Ferrara, Jr. .
5,341,161 8/1994 Yamakawa ..... 347/87
5,343,226 8/1994 Niedermeyeyr .
5,348,192 9/1994 Sardynski .
5,351,073 9/1994 Kageyama .
5,359,353 10/1994 Hunt .
5,359,356 10/1994 Ecklund .
5,359,357 10/1994 Takaki .
5,365,260 11/1994 Kitani .
5,365,262 11/1994 Hattori .
5,368,070 11/1994 Bosley .
5,369,429 11/1994 Erickson .
5,372,306 12/1994 Yianilos .
5,381,172 1/1995 Ujita .
5,385,331 1/1995 Allread .
5,390,702 2/1995 Smith, III .
5,394,177 2/1995 McCann .
5,396,268 3/1995 Mader .
5,400,066 3/1995 Matsumoto .
5,400,573 3/1995 Crystal .
5,402,982 4/1995 Atkinson .
5,406,320 4/1995 Durst .
5,408,256 4/1995 Keen .
5,426,459 6/1995 Kaplinsky .
5,500,665 3/1996 Ujita et al. ..... 347/86
5,537,134 7/1996 Baldwin et al. ..... 347/85
5,552,815 9/1996 Shimoda ..... 347/85

FILLING INK SUPPLY CONTAINERS

BACKGROUND AND SUMMARY OF THE INVENTION

The present invention relates to a method and apparatus for filling and refilling replaceable ink supply containers for ink-jet pens.

A typical ink-jet printer has a pen mounted to a carriage that is moved back and forth over a printing surface, such as a piece of paper. The pen includes a print head. As the print head passes over appropriate locations on the printing surface, a control system activates ink jets on the print head to eject, or jet, ink drops onto the printing surface and form desired images and characters. To work properly, such printers must have a reliable supply of ink for the print head.

Some printers use replaceable reservoirs or ink supplies. These supply containers are not located on the carriage and, thus, are not moved with the print head during printing. Replaceable ink supplies are often plastic bags filled with ink. The bag is provided with a mechanism, such as a septum which can be punctured by a hollow needle for coupling it to the printer so that ink may flow from the bag to the print head.

The presence of air within the ink that is supplied to the print head usually leads to printing problems, including failure of the print head. An air bubble can cause a print head to deprime when, because of the air bubble, ink fails to refill the minute chambers from which print head ink is jetted. Consequently, systems for delivering the ink to the print head must ensure that the ink is substantially free of air. Air is likely to be trapped in a reservoir or container at the time the container is initially filled or refilled with ink.

The present invention provides a method and apparatus for efficiently filling the reservoir of an ink supply container, which ink is thereafter used to supply a print head.

As one aspect of this invention, the reservoir is filled by an efficient, clean process that substantially eliminates the presence of air within the ink supply container.

The principles employed in the present invention are also applicable to systems for refilling a depleted ink supply container.

Other aspects of the invention will become apparent to those skilled in the art from the detailed description of the invention which is presented by way of example and not as a limitation of the present invention.

DESCRIPTION OF THE ILLUSTRATED EMBODIMENT

Figure 1:
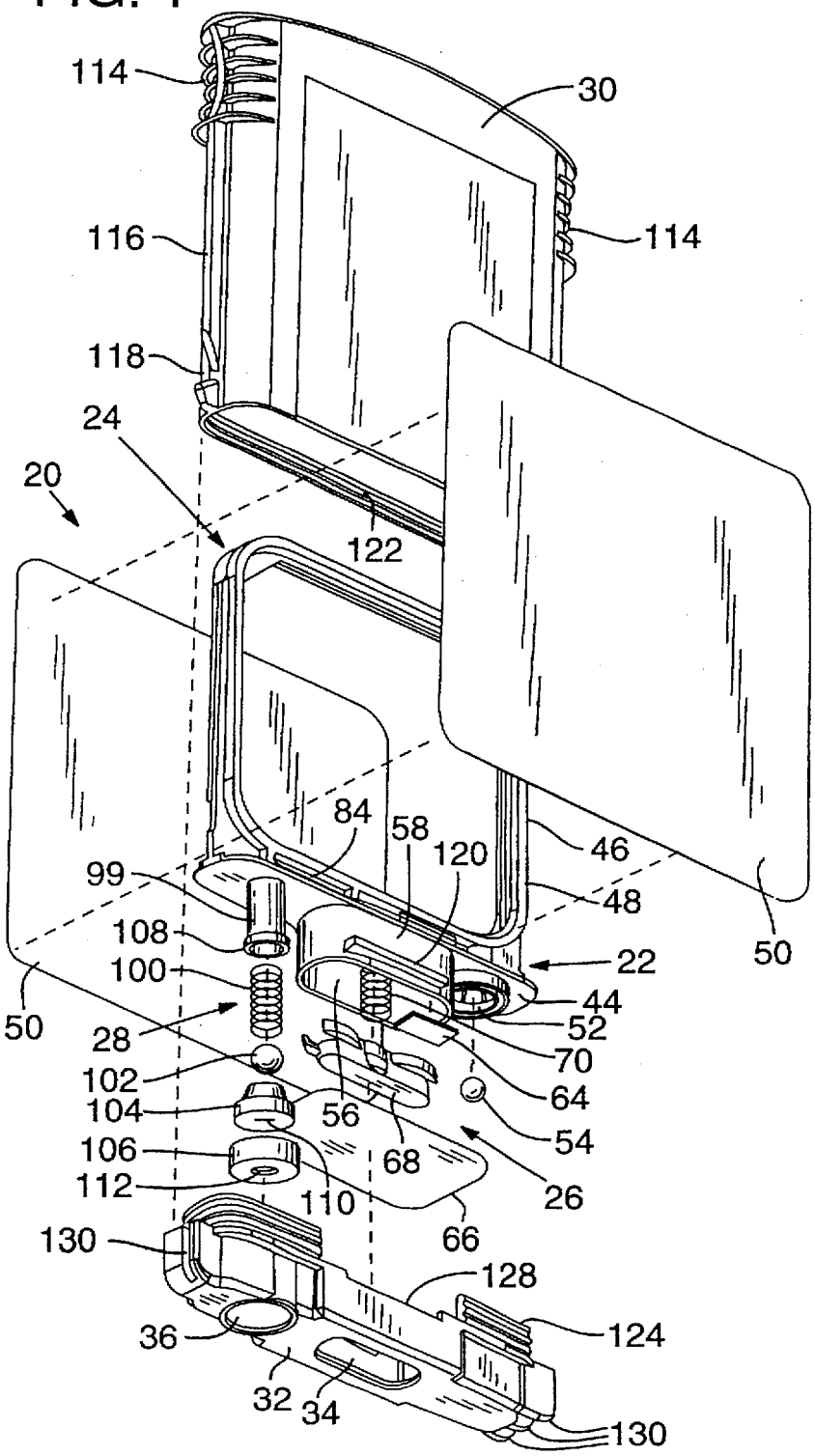
FIG. 1 is an exploded perspective view of an ink supply that is particularly adaptable for filling by the apparatus and method of the present invention.

An ink supply container (hereafter occasionally referred to simply as an ink supply) that is adapted for filling in accordance with a preferred embodiment of the present invention is illustrated in FIG. 1 as reference numeral 20. The ink supply 20 has a chassis 22 that carries an ink reservoir 24 for containing ink. The chassis also includes a pump 26 and fluid outlet 28. The chassis 22 is generally enclosed within a hard protective shell 30 having a cap 32 affixed to its lower end (see FIG. 2). The cap 32 is provided with an aperture 34 to allow access to the pump 26 and an aperture 36 to allow access to the fluid outlet 28.

Figure 2:
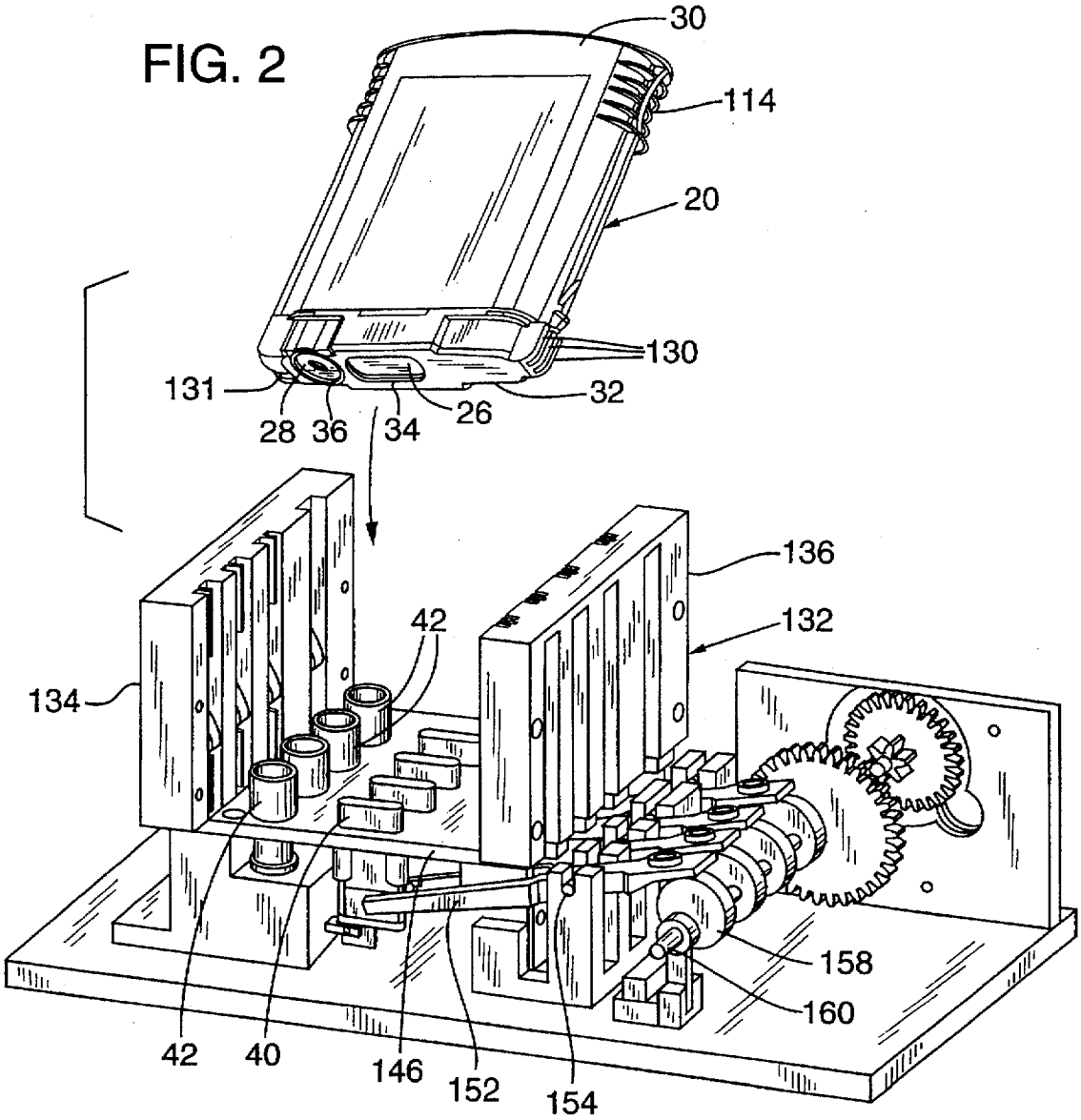
FIG. 2 is a perspective view of the ink supply container shown as it is inserted into a docking station in the printer.
Figure 3:
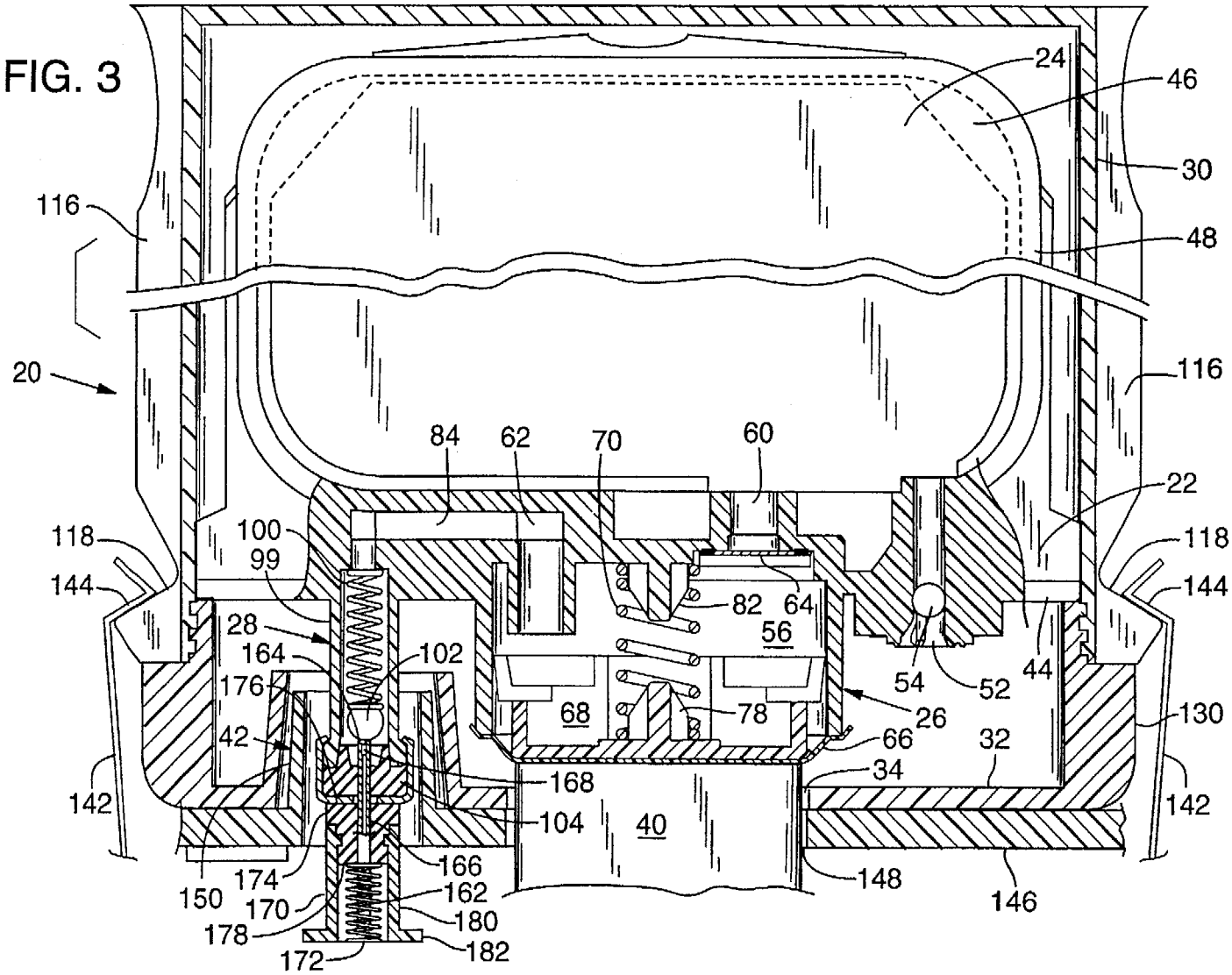
FIG. 3 is a cross sectional view of the container shown inserted into the docking station.

The ink supply 20 can be inserted into one of several docking bays of a docking station 132 that is mounted to an ink-jet printer, as illustrated in FIGS. 2 and 3. Upon insertion of the ink supply 20, an actuator 40 within the docking station is brought into contact with the pump 26 through aperture 34. In addition, a fluid inlet 42 within the docking bay is coupled to the fluid outlet 28 of the supply 20 through aperture 36 to create a fluid path from the ink supply to the printer. Operation of the actuator 40 causes the pump 26 to draw ink from the reservoir 24 and supply the ink through the fluid outlet 28 and the fluid inlet 42 to the printer as described below.

Upon depletion of the ink from the reservoir 24, or for any other reason, the ink supply 20 can be easily removed from the docking bay. Upon removal, the fluid outlet 28 and the fluid inlet 42 close to prevent any residual ink from leaking into the printer or onto the user. The ink supply may then be discarded or refilled and a new ink supply inserted into the docking bay. In this manner, the present ink supply 20 provides a user of an ink-jet printer a simple, economical way to provide a reliable, and easily replaceable supply of ink to an ink-jet printer.

As illustrated in FIGS. 1 and 3, the chassis 22 has a main body portion 44. Extending upward from the top of the chassis body 44 is a frame 46 which helps define and support the ink reservoir 24. In the illustrated embodiment, the frame 46 defines a generally square reservoir 24 having a thickness determined by the thickness of the frame 46 and having open sides. Each side of the frame 46 is provided with a face 48 to which a sheet of plastic 50 is attached to enclose the sides of the reservoir 24. The illustrated plastic sheet is flexible to allow the volume of the reservoir to vary as ink is depleted from the reservoir. This helps to allow all of the ink within the reservoir to be withdrawn and used by minimizing the amount of backpressure created as ink is depleted from the reservoir. The illustrated ink supply 20, is intended to contain about 30 cubic centimeters of ink when full. The dimensions of the container may vary depending on the desired size of the ink supply and the dimensions of the printer in which the ink supply is to be used.

In the illustrated embodiment, the plastic sheets 50 are heat staked to the faces 48 of the frame in a manner well known to those in the art. The plastic sheets 50 are, in the illustrated embodiment, multi-ply sheets having a an outer layer of low density polyethylene, a layer of adhesive, a layer of metallized polyethylene terephthalate, a layer of adhesive, a second layer of metallized polyethylene terephthalate, a layer of adhesive, and an inner layer of low density polyethylene. The layers of low density polyethylene are about 0.0005 inches thick and the metallized polyethylene terephthalate is about 0.00048 inches thick. The low density polyethylene on the inner and outer sides of the plastic sheets can be easily heat staked to the frame while the double layer of metallized polyethylene terephthalate provides a robust barrier against vapor loss and leakage. Of course, in other embodiments, different materials, alternative methods of attaching the plastic sheets to the frame, or other types of reservoirs might be used.

The body 44 of the chassis 22, as seen in FIGS. 1 and 3, is provided with a fill port 52 to allow ink to be introduced into the reservoir. After filling the reservoir, as described more fully below, a plug 54 is inserted into the fill port 52 to prevent the escape of ink through the fill port. In the illustrated embodiment, the plug is a polypropylene ball that is press fit into the fill port.

A pump 26 is also carried on the body 44 of the chassis 22. The pump 26 serves to pump ink from the reservoir and supply it to the printer via the fluid outlet 28. In the illustrated embodiment, seen in FIGS. 1 and 3, the pump 26 includes a pump chamber 56 that is integrally formed with the chassis 22. The pump chamber is defined by a skirt-like wall 58 which extends downwardly from the body 44 of the chassis 22.

A pump inlet 60 is formed at the top of the chamber 56 to allow fluid communication between the chamber 56 and the ink reservoir 24. A pump outlet 62 through which ink may be expelled from the chamber 56 is also provided. A valve 64 is positioned within the pump inlet 60. The valve 64 allows the flow of ink from the ink reservoir 24 into the chamber 56 but limits the flow of ink from the chamber 56 back into the ink reservoir 24. In this way, when the chamber is depressurized, ink is drawn from the ink reservoir, through the pump inlet and into the chamber and when the chamber is pressurized ink within the chamber is expelled through the pump outlet.

In the illustrated embodiment, the valve 64 is a one-way flapper valve positioned at the bottom of the pump inlet. The flapper valve 64, illustrated in FIGS. 1 and 3, is a rectangular piece of flexible material. The valve 64 is positioned over the bottom of the pump inlet 60 and heat staked to the chassis 22 at the midpoints of its short sides (the heat staked areas are darkened in FIG. 3). When the pressure within the chamber drops sufficiently below that in the reservoir, the unstaked sides of the valve each flex downward to allow the flow of ink through the pump inlet 60 and into the chamber 56. In alternative embodiments, the flapper valve could be heat staked on only one side so that the entire valve would flex about the staked side, or on three sides so that only one side of the valve would flex. Other types of valves may also be suitable.

In the illustrated embodiment the flapper valve 64 is made of a two-ply material. The top ply is a layer of low density polyethylene 0.0015 inches thick. The bottom ply is a layer of polyethylene terephthalate (PET) 0.0005 inches thick. The illustrated flapper valve 64 is approximately 5.5 millimeters wide and 8.7 millimeters long. Of course, in other embodiments, other materials or other types or sizes of valves may be used.

A flexible diaphragm 66 encloses the bottom of the chamber 56. The diaphragm 66 is slightly larger than the opening at the bottom of the chamber 56 and is sealed around the bottom edge of the wall 58. The excess material in the oversized diaphragm allows the diaphragm to flex up and down to vary the volume within the chamber. In the illustrated ink supply, the displacement of the diaphragm allows the volume of the chamber 56 to be varied by about 0.7 cubic centimeters. The fully expanded volume of the illustrated chamber 56 is between about 2.2 and 2.5 cubic centimeters.

In the illustrated embodiment, the diaphragm 66 is made of the same multiply material as the plastic sheets 50. Of course, other suitable materials may also be used to form the diaphragm. The diaphragm in the illustrated embodiment is heat staked, using conventional methods, to the bottom edge of the skirt-like wall 58. During the heat staking process, the low density polyethylene in the diaphragm seals any folds or wrinkles in the diaphragm to create a leak proof connection.

A pressure plate 68 and a spring 70 are positioned within the chamber 56. The pressure plate 68 has a smooth lower face 72 with a wall extending upward about its perimeter. The central region 76 of the pressure plate 68 is shaped to receive the lower end of the spring 70 and is provided with a spring retaining spike 78. Four wings 80 extend laterally from an upper portion of the wall. The illustrated pressure plate is molded of high density polyethylene.

The pressure plate 68 is positioned within the chamber 56 with the lower face 72 adjacent the flexible diaphragm 66. The upper end of the spring 70, which is stainless steel in the illustrated embodiment, is retained on a spike 82 formed in the chassis and the lower end of the spring 70 is retained on the spike 78 on the pressure plate 68. In this manner, the spring biases the pressure plate downward against the diaphragm to increase the volume of the chamber. The wall and wings 80 serve to stabilize the orientation of the pressure plate while allowing for its free, piston-like movement within the chamber 56.

Although the ink reservoir 24 provides an ideal way to contain ink, it may be easily punctured or ruptured and may allow a small amount of water loss from the ink. Accordingly, to protect the reservoir 24 and to further limit water loss, the reservoir 24 is enclosed within a protective shell 30. In the illustrated embodiment, the shell 30 is made of clarified polypropylene. A thickness of about one millimeter has been found to provide robust protection and to prevent unacceptable water loss from the ink. However, the material and thickness of the shell may vary in other embodiments.

As illustrated in FIG. 1, the top of the shell 30 has contoured gripping surfaces 114 that are shaped and textured to allow a user to easily grip and manipulate the ink supply 20. A vertical rib 116 having a detente 118 formed near its lower end projects laterally from each side of the shell 30. The base of the shell 30 is open to allow insertion of the chassis 22. A stop 120 extends laterally outward from each side of wall 58 that defines the chamber 56. These stops 120 abut the lower edge of the shell 30 when the chassis 22 is inserted into the shell.

A protective cap 32 is fitted to the bottom of the shell 30 to maintain the chassis 22 in position. The cap 32 is provided with recesses 128 that receive the stops 120 on the chassis 22. In this manner, the stops are firmly secured between the cap and the shell to maintain the chassis in position. The cap is also provided with an aperture 34 to allow access to the pump 26 and with an aperture 36 to allow access to the fluid outlet 28. The cap 32 obscures the fill port to help prevent tampering with the ink supply.

A conduit 84 joins the pump outlet 62 to the fluid outlet 28 (FIG. 3). In the illustrated embodiment, the top wall of the conduit 84 is formed by the lower member of the frame 46, the bottom wall is formed by the body 44 of the chassis, one side is enclosed by a portion of the chassis and the other side is enclosed by a portion of one the plastic sheets 50.

As illustrated in FIGS. 1 and 3, the fluid outlet 28 is housed within a hollow cylindrical boss 99 that extends downward from the chassis 22. The base of the boss 99 opens into the conduit 84 to allow ink to flow from the conduit into the fluid outlet. A spring 100 and sealing ball 102 are positioned within the housing boss 99 and are held in place by a compliant septum 104 and a crimp cover 106. The length of the spring 100 is such that it can be placed into the inverted boss 99 with the bail 102 on top. The septum 104 can then inserted be into the boss 99 to compress the spring 100 slightly so that the spring biases the sealing bail 102 against the septum 104 to form a seal. The crimp cover 106 fits over the septum 104 and engages an annular projection 108 on the boss 99 to hold the entire assembly in place.

In the illustrated embodiment, both the spring 100 and the bail 102 are stainless steel. The sealing bail 102 is sized such that it can move freely within the boss 99 and allow for the flow of ink around the ball when it is not in the sealing position. The septum 104 is formed of polyisoprene rubber and has a concave bottom to receive a portion of the ball 102 to form a secure seal. The septum 104 is provided with a slit 110 so that it may be easily pierced. However, the slit is normally closed such that the septum itself forms a second seal. The illustrated crimp cover 106 is formed of aluminum and has a thickness of about 0.020 inches. A hole 112 is provided so that the crimp cover 106 does not interfere with the piercing of the septum 104.

The illustrated ink supply 20 is ideally suited for insertion into a docking station 132 like that illustrated in FIG. 2. The illustrated docking station 132 is intended for use with a color printer. Accordingly, it has four side-by-side docking bays 38, each of which receives one ink supply container 20 of a different color. The structure of the illustrated ink supply allows for the supply to be relatively narrow in width. This allows for four ink supplies to be arranged side-by-side in a compact docking station without unduly increasing the "footprint" of the printer.

The docking bays 38 reside between opposing walls 134 and 136. Each wall respectively defines keys and keyways for guiding the fluid outlet 28 of a supply 20 into place for coupling with the inlet 42 (which corresponds to the color of ink carried in the supply reservoir 24) of a corresponding bay 38.

With reference to FIGS. 2 and 3, a base plate 146 defines the bottom of the docking station 132. The base plate 146 includes an aperture 148 through which the actuator 40 protrudes. The base plate also carries a housing 150 for the fluid inlet 42.

The upper end of each actuator 40 extends through the aperture 148 in the base plate 146 and into the docking bay 38. The lower portion of the actuator 40 is positioned below the base plate and is pivotably coupled to one end of a lever 152 which is supported on pivot point 154. The other end of the lever 154 is biased downward by a compression spring (not shown). In this manner, the force of the compression spring urges the actuator 40 upward. A cam 158 mounted on a rotatable shaft 160 is positioned such that rotation of the shaft to an engaged position causes the cam to overcome the force of the compression spring and move the actuator 40 downward. Movement of the actuator causes the pump 26 to draw ink from the reservoir 24 and supply it through the fluid outlet 28 and the fluid inlet 42 to the printer.

As seen in FIG. 3, the fluid inlet 42 is positioned within the housing 150 carried on the base plate 146. The illustrated fluid inlet 42 includes an upwardly extending needle 162 having a closed blunt upper end 164, a blind bore 166 and a lateral hole 168 near the blunt end. A trailing tube (not shown) is connected to the lower end of the needle 162 such that the blind bore 166 is in fluid communication therewith. The trailing tube leads to a print head.

A sliding collar 170 surrounds the needle 162 and is biased upwardly by a spring 172. The sliding collar 170 has a compliant sealing portion 174 with an exposed upper surface 176 and a lower surface 178 in direct contact with the spring 172. In addition, the illustrated sliding collar includes a substantially rigid portion 180 extending downwardly to partially house the spring 172. An annular stop 182 extends outward from the lower edge of the substantially rigid portion 180. The annular stop 182 is positioned beneath the base plate 146 such that it abuts the base plate to limit upward travel of the sliding collar 170 and define an upper position of the sliding collar on the needle 162. In the upper position (not shown), the lateral hole 168 is surrounded by the sealing portion 174 of the collar to seal the lateral hole and the blunt end 164 of the needle is generally even with the upper surface 176 of the collar.

As the ink supply 20 is inserted into the docking bay 38, the bottom of the fluid outlet 28 pushes the sliding collar 170 downward, as illustrated in FIG. 3. Simultaneously, the needle 162 passes through the septum 104 to depress the sealing ball 102. Thus, in the fully inserted position, ink can flow from the boss 99, around the sealing ball 102, into the lateral hole 168, down the bore 166, through the trailing tube to the print head.

When the ink supply 20 is pushed downward into the installed position, shown in FIG. 3, the bottom of the cap 32 abuts the base plate 146, and the actuator 40 enters the aperture 34 in the cap 32 to pressurize the pump.

In this installed position, engagement prongs 144 on each side of the docking station engage detents 118 formed in the shell 30 to firmly hold the ink supply in place. Leaf springs 142, which allow the engagement prongs to move outward during insertion of the ink supply, bias the engagement prongs inward to positively hold the ink supply in the installed position. Throughout the installation process and in the installed position, the edges of the ink supply 20 are captured between the station walls 134, 136 which provide lateral support and stability to the ink supply.

To remove the ink supply 20, a user simply grasps the ink supply, using the contoured gripping surfaces 114, and pulls upward to overcome the force of the leaf springs 142.

Upon removal of the ink supply 20, the needle 162 is withdrawn and the spring 100 presses the sealing ball 102 firmly against the septum to establish a robust seal. In addition, the slitted septum closes to establish a second seal, both of which serve to prevent ink from leaking through the fluid outlet 28. At the same time, the spring 172 pushes the sliding collar 170 back to its upper position in which the lateral hole 168 is encased within the sealing portion of the collar 174 to prevent the escape of ink from the fluid inlet 42. Finally, the seal between the crimp cover 106 and the upper surface 176 of the sliding collar is broken. With this fluid interconnect, little, if any, ink is exposed when the fluid outlet 28 is separated from the fluid inlet 42. This helps to keep both the user and the printer clean.

As discussed above, the illustrated docking station 132 includes four side-by-side docking bays 38. In this illustrated configuration, this allows the station walls 134, 136 and base plate 146 to be unitary. In the illustrated embodiment, the leaf springs for each side of the four docking bays can be formed as a single piece connected at the bottom. In addition, the cams 158 for each docking station are attached to a single shaft 188. Using a single shaft results in each of the four ink supplies being refreshed when the pump of any one of the four reaches its minimum operational volume.

Figure 3A:
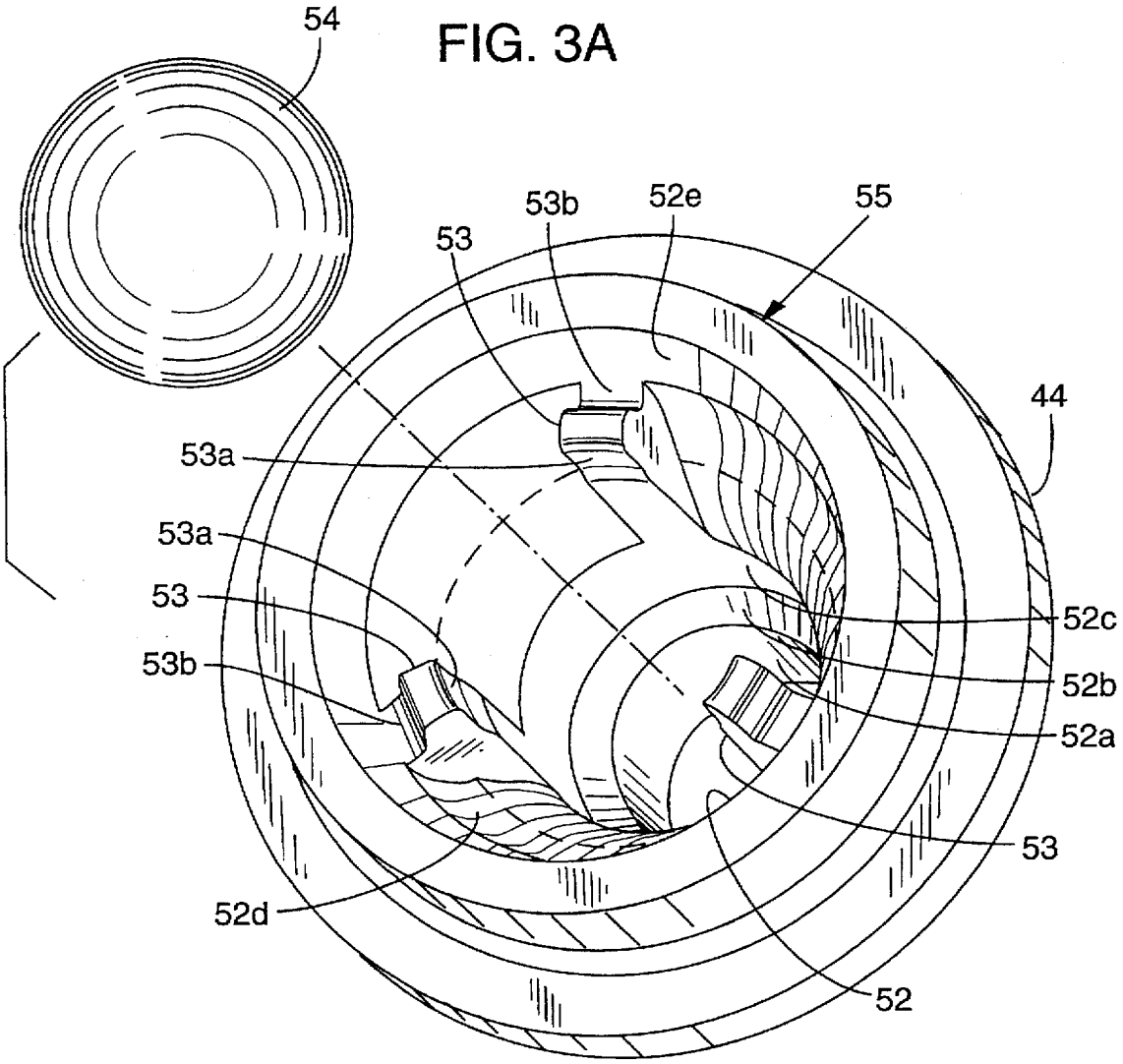
FIG. 3*a* is an enlarged, detail cross section of the container fill port.
Figure 4:
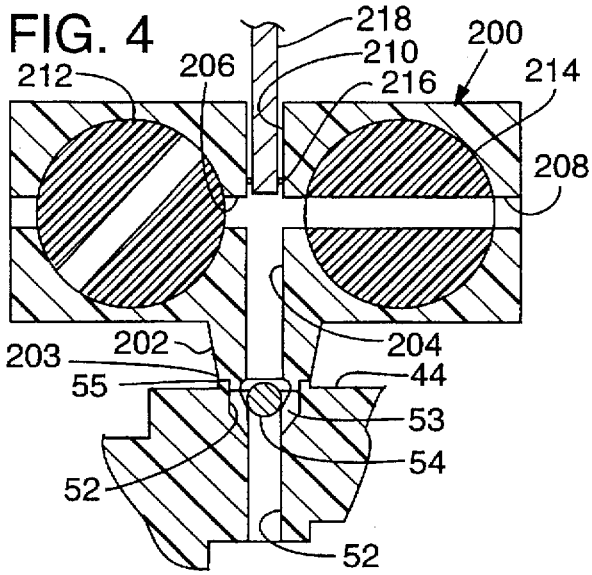
FIG. 4 is a diagram of a valved nozzle assembly shown sealed against the fill port of a container and having its two valves in a state for evacuating gas from the container prior to filling the container with ink.

Turning now to the preferred methods and apparatus for filling the ink supply 20, particular reference is directed to FIGS. 3*a* and 4. The ink supply 20 is ready for filling when the chassis 22 and its attached reservoir 24 are coupled to the shell 30, before the protective cap 32 is connected. Preferably the ink supply container is moved to a filling station in which the container is supported in a position that is inverted from that shown in FIG. 3.

FIG. 3*a* shows in perspective view the portion of the chassis body 44 in which is defined the fill port 52. FIG. 3*a* shows the fill port before the plug 54 is positioned to seal the port as mentioned above. The fill port 52 has a generally uniform-diameter lower portion 52*a* that opens to the interior of the reservoir. Above the lower portion 52*a* ("above" for the purposes of the referenced drawings meaning away from the reservoir) the port surface has a tapered portion 52*b* that is contiguous on its upper edge with an enlarged-diameter portion 52*c* (enlarged relative to the diameter of the lower portion 52*a*). The upper edge of the enlarged-diameter portion 52*c* blends with the lower edge of a contoured surface portion 52*d*, the configuration of which is described more fully below.

The upper edge of the contoured surface 52*d* joins the lower edge of a conical surface portion 52*e* that defines the inner surface of an annular rim 55 that projects upwardly somewhat from the body 44 of the chassis.

Figure 6:
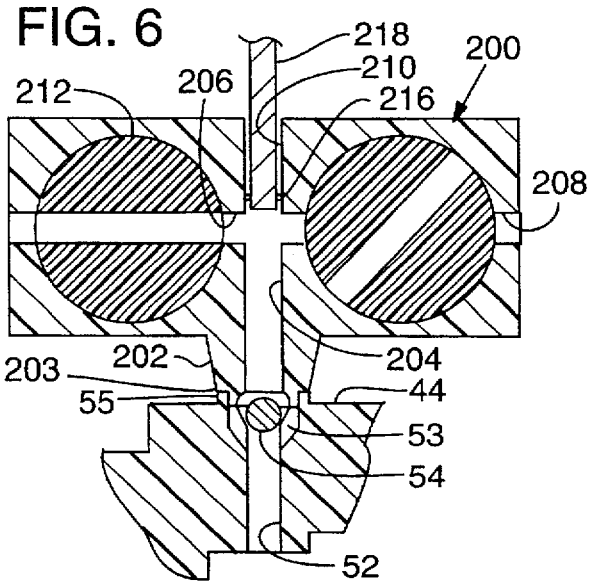
FIG. 6 is a diagram like FIG. 4 but showing the valves of the nozzle assembly in a state for directing ink into the fill port of the container.
Figure 7:
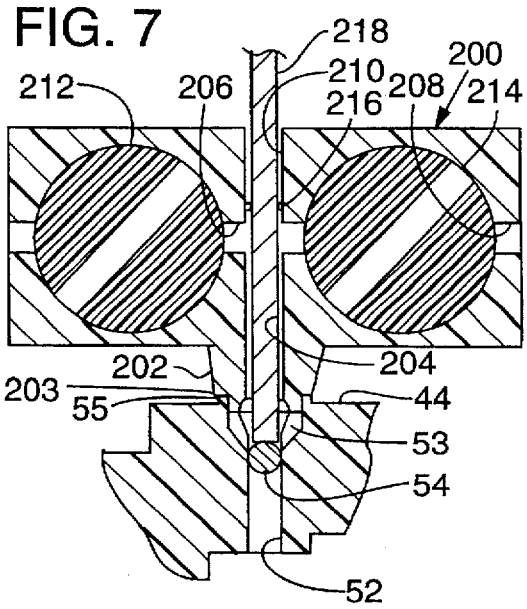
FIG. 7 is a diagram similar to FIG. 4, showing a ram part of the nozzle assembly forcing a plug into the fill port to seal the port after the container is filled.

Three evenly spaced fins 53 (only two of which are shown in FIGS. 4, 6 and 7) are formed in the contoured surface portion 52*d* to project inwardly therefrom. The fins 53 project inwardly by an amount sufficient to secure the spherical plug 54 in an intermediate position, centered in the port 52 but spaced from the contoured surface portion 52*d*. To this end, the innermost surface of each fin includes a cupped region 53*a*, the curvature of which generally conforms to the curvature of the plug 54.

In a preferred embodiment, a plug 54 that is dropped into the center of the port 52 will seat within the cupped regions 53*a* of the fins 53. As will be described, fluid can flow around the plug On its intermediate position) for evacuating and filling the supply container. In an alternative embodiment, the fins could be shaped such that a small amount of force is needed to fit the plug into the intermediate position to ensure the plug remains in that position until the filling process is complete.

With the plug 54 in the just described intermediate position (as depicted in FIG. 4), a nozzle assembly 200 is lowered into place in contact with the chassis body. Specifically, the assembly 200 includes a downwardly protruding tapered nozzle 202. The lowermost end of the nozzle periphery is conical shaped and fits snugly against and seals to the conical surface portion 52*e* of the port rim 55. The nozzle movement is controlled so that it does not extend downwardly beyond the conical surface portion 52*e*. Moreover, the nozzle movement is limited by contact between an annular shoulder 203 that protrudes from the conical nozzle surface and abuts the upper most surface 52*f* of the rim 55. The fins 53, have defined in their uppermost ends a recessed surface 53*b* to provide clearance for the edge of the nozzle.

In a preferred embodiment, the nozzle 202 is formed of a rigid material, such as metal, that tightly seals against the plastic surface of the fill port 52.

The nozzle 202 has a bore 204, the diameter of which is greater than the diameter of the spherical plug 54, so that as the nozzle is moved into sealing contact with the surface portion 52*e* of the fill port 52, the nozzle does not interfere with the intermediate positioning of the plug 54.

Moreover, referring again to FIG. 3*a*, the space between the plug 54 and the inner surfaces of the fill port is sufficient to provide a passage for substantially laminar flow or, at least, flow with very low turbulence, around the plug. Such flow is desirable for maximizing the speed with which the ink supply can be filled, and for minimizing the opportunity for dissolved air to escape from the ink. In this regard, the fins 53 are sized so that the plug is held in the intermediate position with its exterior surface spaced a minimum distance from the nearest surface portion of the port wall by an amount such that the smallest cross sectional area of the space between the ball and port wall is not less than the cross sectional area of the lower diameter portion 52*a* of the port.

The contoured surface portion 52*d* facilitates the desirable laminar flow characteristic of the ink through the port. That surface is slightly concave (having a minimum radius of about 3 mm) in the region nearest the intermediately supported plug (that is, the region above the dashed line in FIG. 3*a*). The lower region of the contoured surface portion 52*d* has a smooth transition with the upper region (at the dashed line in FIG. 3*a*) and defines a generally convex surface (having a minimum radius of about 3 mm) that joins with a smooth radius the upper edge of the enlarged-diameter portion 52*c*.

The lower end of the nozzle bore 204 is shaped to define a concave portion corresponding in curvature to the concave surface 52*d* in the port. As a result, the surface 52*d* and corresponding portion of the needle bore define a generally spherical space in the vicinity of the plug in the intermediate position.

Referencing again FIGS. 3–7, the inner end of bore 204 in the nozzle terminates at a junction of three conduit branches: an ink conduit branch 206, a gas conduit branch 208, and a ram conduit branch 210. A fluid control valve 212 (shown schematically in FIGS. 4, 6 and 7) is carried by the assembly 200 and is operable for occluding (FIG. 4) and opening (FIG. 6) the ink conduit branch 206.

Similarly, another fluid control valve 214 is carried by the assembly and connected to gas conduit branch 208. That valve 214 is also operable for opening (FIG. 4) and occluding (FIG. 6) the gas conduit branch 208.

In a preferred embodiment, the valves 212, 214 may be any manually or electronically operated valves for opening and closing their associated conduit branches. For convenience, valve 212 will be referred to as the left valve and valve 214 as the fight valve.

The ram conduit branch 210 is a linear extension of the nozzle bore 204. Within the wall of the ram conduit branch 210 there is an annular groove in which is seated an O-ring 216 that seals around an elongated, blunt-ended ram 218 that can be forced into and out of a fill port 52, as described more fully below.

In a preferred embodiment, the valves 212, 214 may be any manually or electronically operated valves for opening and closing their associated conduit branches. For convenience, valve 212 will be referred to as the left valve and valve 214 as the fight valve.

The ram conduit branch 210 is a linear extension of the nozzle bore 204. Within the wall of the ram conduit branch 210 there is an annular groove in which is seated an O-ring 216 that seals around an elongated, blunt-ended ram 218 that can be forced into and out of a fill port 52, as described more fully below.

Figure 5:
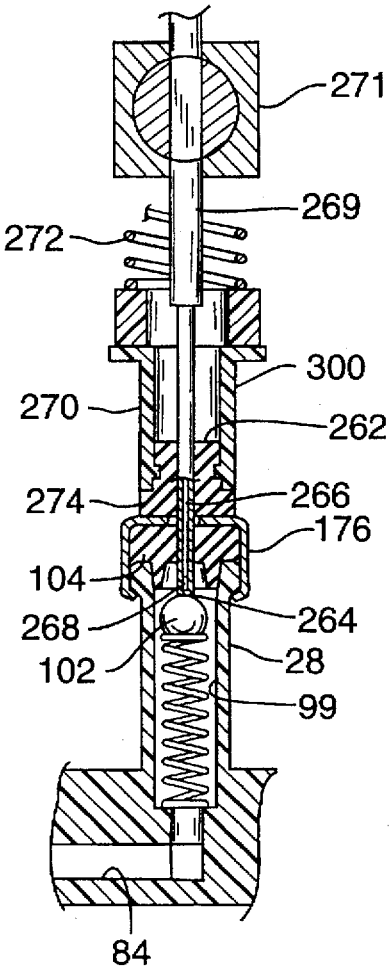
FIG. 5 depicts a vacuum needle assembly connectable to the fluid outlet of the container for removing gas from the container as part of the filling process.

The above-described nozzle assembly 200 is used in conjunction with a needle assembly 300 shown in FIG. 5. The needle assembly 300 is, in many respects, similar to the fluid inlet 42 described above, as will become clear. During the filling operation, the needle assembly is positioned adjacent to the fluid inlet 28 of the supply 20.

The needle assembly includes a downwardly extending needle 262 that has a closed blunt lower end 264, a blind bore 266, and a lateral hole 268. A tube 269 is connected to the upper end of the needle 262 so that the needle bore 266 is in fluid connection with the tube 269. The tube 269 has connected to it a valve 271 that is operable for opening and dosing the tube to a vacuum source (not shown).

The needle assembly 300 is shown engaging the fluid outlet 28 of the above-described ink supply 20. In this position, a collar 270 that surrounds the needle 262 is urged downwardly by a spring 272. The collar 270 has a compliant sealing portion 274 through which tightly fits the needle 262. The lowermost planar surface 276 of the compliant member fits against the flat surface of the crimp cover 176 of the fluid outlet. In the engaged position the needle 262 is forced through the slit in the septum 104 of the fluid outlet to depress the sealing ball 102. Thus, a passage for gas flow from the reservoir 24 is created through the conduit 84 and the contiguous interior of the boss 99, out of the supply container through the lateral hole and bore of the needle 262, and into the tube 269.

In a preferred method of filling the reservoir 24, air or other gas is first removed from the empty reservoir 24. To this end, the nozzle assembly 200, with the nozzle in the sealed position (FIG. 4) is operated so that the left valve 212 is closed and the right valve 214 is open. Similarly, the needle assembly 300 is placed in the engaged position with respect to the fluid inlet, as indicated in FIG. 5. The gas conduit branch 208 of the nozzle assembly 200 and the tube 269 of the needle assembly 300 (with valve 271 opened) are then connected to a vacuum source for evacuating the contents of the container, including the reservoir 24, chamber 56, fill port 52, and fluid outlet 28. In a preferred embodiment, the container is evacuated to about 28 inches Hg.

Once the ink container is evacuated, the passage through tube 269 of the needle assembly 300 is closed, either by closing valve 271 or by withdrawing the needle 262 by an amount sufficient for the needle to be retracted into the compliant member 274 with its lateral hole 268 sealed against the interior of that compliant member. The nozzle assembly 200 remains in the sealed position, and the right valve 214 is closed and the left valve 212 is opened (see FIG. 6) so that a measured amount of ink may be pumped through the ink conduit branch 206 and be directed through the nozzle bore 204 around the plug 54 to fill the ink cartridge. In a preferred embodiment, the ink will fill the reservoir such that the plug 54 is immersed in ink within the fill port 52.

With the nozzle assembly 200 remaining in the sealed position, the left valve 212 is closed and the right valve 214 is also closed. The ram 218 is then forced downwardly so that its blunt end contacts the bail plug 54 to force the plug into the uniform diameter portion of the fill port and to seal that port as shown in FIG. 7. The ram 218 is thereafter retracted.

Residual ink present above the sealed ball 54 is removed while the fill nozzle remains in the sealed orientation. To this end, the fight valve 214 remains opened (while the left valve 212 remains closed) and vacuum is applied to the gas conduit branch 208. The residual ink is, therefore, drawn out through the branch 208. Preferably, the vacuum applied for removing the ink is continuously applied as the nozzle assembly is raised from the ink supply chassis and the seal between the nozzle and the chassis is broken, thereby to remove any additional residual ink that may have been trapped at the junction of the nozzle and the fill port.

In an alternative preferred approach to filling the ink supply, prior to evacuation of the empty container, the entire container can be flushed with a gas that, compared to air, is very soluble with ink. One such gas is carbon dioxide. Accordingly, after the container is flushed with carbon dioxide gas and evacuated, any gas that may still be trapped in the container will be carbon dioxide, which is far more likely than air to remain dissolved in the ink and thereby avoid the printing problems encountered if air remains trapped in the container (hence, in the ink supply), as described above.

The just mentioned gas flush process can be applied when the nozzle assembly 200 and the needle assembly 300 are moved against the ink container into the sealed positions (FIGS. 4 and 5), and the container is evacuated as explained above. When the evacuation is complete, the valve 271 connected to the tube 269 is closed. The left valve 212 of the fill fixture is also closed, and the right valve 214 is opened while the gas conduit branch 208 is connected to a source of carbon dioxide gas. The entire container is filled with the gas to a pressure of about 3 psi. Thereafter, the container is again evacuated and filled with ink as described above.

It is also contemplated that when the container is filled with ink, any air trapped between the inlet valve 64 of the pump 26 and the septum 104 may be removed or "burped" from the system. To this end, the needle assembly 300 may be lowered into position with the needle penetrating the septum (as shown in FIG. 5) and valve 271 opened. An actuator is then moved against the pump diaphragm 66 of the supply to depress the diaphragm and reduce the chamber 56 volume for forcing a small amount of fluid, including any trapped air, through the needle 262. The needle is thereafter retracted to seal the fluid outlet 28 while the diaphragm is depressed.

Figure 8:
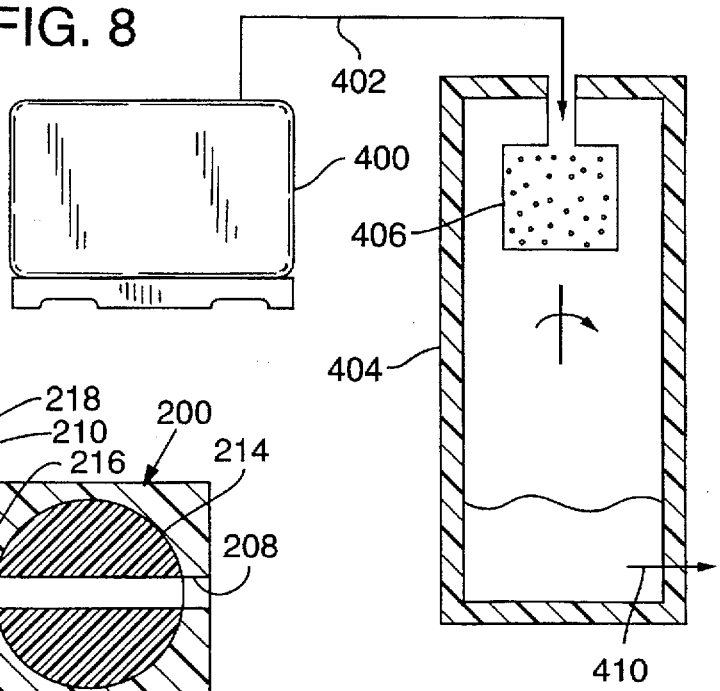
FIG. 8 is a diagram of a preferred technique for developing a source of degassed ink with which to fill the container in accordance with the present invention.

In another preferred approach to the fill process, the ink that is provided to the reservoir is first processed to remove dissolved air. This process is schematically represented in FIG. 8, which depicts a vessel 400 containing ink that is pumped via line 402 into a vacuum chamber 404, the interior of which is maintained at approximately 28 inches Hg. The ink that enters the vacuum chamber is directed into a rapidly rotating basket 406 that is perforated with apertures of about one millimeter diameter. The ink emanates from the perforations in small droplets or streams having substantially large surface areas for facilitating the escape of any trapped gasses in the ink. This degassed ink flows down the sides of the vacuum chamber 104 and pools at the bottom, from where it is pumped through a conduit 410 into the ink conduit branch 206 of the needle assembly 200 for filling the ink container as discussed above.

This detailed description is set forth only for purposes of illustrating examples of the present invention and should not be considered to limit the scope thereof in any way. Clearly, numerous additions, substitutions, and other modifications can be made to the invention without departing from the scope of the invention which is defined in the appended claims and equivalents thereof. For example, it is contemplated that the foregoing filling process could also be used to refill a supply 20. The plug 54 would be moved (inwardly or outwardly) from the port 52 to permit the refilling. The unplugged, empty chamber can thereafter be evacuated and filled as described above.

The invention claimed is:

1. A method of filling an ink container through a port in the container, comprising the steps of:

removing gas from the container;

directing ink into the container through the port;

plugging the port in the container;

wherein the removing step includes applying vacuum to the container port; and wherein the removing step also includes applying vacuum to the container through a hollow needle that penetrates the container.

2. A method of filling an ink container through a port in the container, comprising the steps of:

removing gas from the container;

directing ink into the container through the port;

plugging the port in the container;

wherein the directing step includes the substep of sealing the port with a nozzle, through which sealed nozzle and port the ink is directed into the container; and wherein the plugging step includes the step of locating a plug within the nozzle near the port before the directing step.

3. A method of filling an ink container through a port in the container, comprising the steps of:

removing gas from the container;

directing ink into the container through the port;

plugging the port in the container;

wherein the plugging step includes the step of locating a plug within the nozzle near the port before the directing step; and wherein the plugging step includes the step of plugging the port with the plug after the directing step and while the nozzle is sealed to the port.

4. A method of filling an ink container through a port in the container, comprising the steps of:

removing gas from the container;

directing ink into the container through the port;

plugging the port in the container;

wherein the directing step includes the substep of sealing the port with a nozzle, through which sealed nozzle and port the ink is directed into the container;

including the step of applying vacuum to the nozzle after the plugging step, thereby to remove residual ink from the vicinity of the port; and including the step of removing the nozzle to break the seal while maintaining the vacuum.

5. A method of filling an ink container through a port in the container, comprising the steps of:

removing gas from the container;

directing ink into the container through the port;

plugging the port in the container;

wherein the directing step is preceded with the step of introducing an ink-soluble gas into the container, wherein the gas is more soluble in ink than is air.

6. The method of claim 5 wherein the gas is carbon dioxide.

7. A method of filling an ink container through a port in the container, comprising the steps of:

removing gas from the container;

directing ink into the container through the port;

plugging the port in the container;

wherein the removing step includes applying vacuum to the container port;

wherein the removing step also includes applying vacuum to the container through a hollow needle that penetrates the container; and wherein the removing step includes applying vacuum to the container by penetrating the container with one end of the needle and applying a suction source to another end of the needle.

8. A method of filling an ink container through a port in the container, comprising the steps of:

removing gas from the container;

directing ink into the container through the port;

plugging the port in the container;

wherein the removing step includes applying vacuum to the container port;

wherein the removing step also includes applying vacuum to the container through a hollow needle that penetrates the container;

wherein the removing step includes applying vacuum to the container by penetrating the container with one end of the needle and applying a suction source to another end of the needle;

wherein the ink container is constructed to have a reservoir for storing the ink directed into the container and a chamber located adjacent to and in fluid communication with the reservoir of the container, the method including the step of decreasing the chamber volume after the ink is directed into the container thereby to move air in the chamber out through the needle.

9. The method of claim 8 including the step of providing a septum on the container, through which the needle penetrates.

10. An ink container and apparatus for filling the same through a fill port provided in the ink container wherein the ink container also has an outlet that is closed with a septum, the combination comprising:

a first nozzle sized to seal against the fill port;

a valved gas line connected to the nozzle, the valve of the gas line being openable to direct gas into and out of the container through the gas line;

a valved ink line connected to the nozzle for selectively directing ink into the container through the nozzle; and a compliant sealing portion sized to contact the outlet of the ink container, the compliant sealing portion including a needle for penetrating the septum and thereby providing a path for gas movement out of the container.

11. A system for filling an ink container through a port, the system comprising:

an ink container having a port with opposing ends;

a movable rigid nozzle sized to seal against an end of the port when moved into contact with the container;

fins connected to the container and protruding into the port;

a plug supported by the fins and sized to permit fluid flow through the sealed nozzle into the port; and wherein the nozzle has an inner bore having a concave part and wherein the end of the port has a concave shaped part.

* * * * *